United States Patent [19]

Daubigny et al.

[11] Patent Number: 4,909,747

[45] Date of Patent: Mar. 20, 1990

[54] SEALED ELECTRICAL CONNECTOR UTILIZABLE IN A LIQUID MEDIUM

[75] Inventors: Philippe Daubigny, Chaville; René Grappe, Paris, both of France

[73] Assignee: Souriau et Cie, Boulogne Billancourt, France

[21] Appl. No.: 250,804

[22] Filed: Sep. 29, 1988

[30] Foreign Application Priority Data

Sep. 29, 1987 [FR] France ..... 87 13444

[51] Int. Cl.[4] ..... H01R 13/44

[52] U.S. Cl. ..... 439/140; 439/141; 439/276

[58] Field of Search ..... 439/140, 141, 146, 197, 439/205, 273, 276

[56] References Cited

U.S. PATENT DOCUMENTS 3,491,326 1/1970 Pfister et al. ..... 439/141
3,845,450 10/1974 Cole et al. ..... 439/141
4,188,084 2/1980 Buresi et al. ..... 439/141
4,589,717 5/1986 Portier et al. ..... 439/140
4,808,127 2/1989 Swanic ..... 439/140

FOREIGN PATENT DOCUMENTS 1202374 10/1965 Fed. Rep. of Germany ..... 439/140

*Primary Examiner*—P. Austin Bradley
*Attorney, Agent, or Firm*—Larson and Taylor

[57] ABSTRACT

In an electrical connector which has to operate in fluid-tight manner in a liquid medium, in which one of the connector elements comprises contacts distributed circumferentially around an axial bore provided with a movable obturator and the other connector element comprises a cylindrical body adapted to penetrate into the bore by pushing back the obturator and provided with contacts distributed over its periphery and borne by insulating bodies of PTFE, the contacts are borne by insulating bodies of elastically deformable elastomer with the possibility of limited radial movement (springs) of the contacts with respect to the insulating bodies.

10 Claims, 4 Drawing Sheets

SEALED ELECTRICAL CONNECTOR UTILIZABLE IN A LIQUID MEDIUM

BACKGROUND OF THE INVENTION

The present invention relates to an arrangement of sealed electrical connector utilizable (particularly connectable or disconnectable in a liquid medium, and particularly under high pressures, for example, at great depth on an ocean floor, for example in offshore petroleum installations.

The invention is directed to the introduction of improvements in electrical connectors which have to function in fluid-tight manner in a liquid medium, comprising two connector elements removably couplable to one another within the liquid medium and bearing respective contacts designed to co-operate in pairs, in which one of the connector elements (or first connector element) comprises:

a jacket having a cylindrical bore, electrical contacts distributed circumferentially at the surface of the cylindrical bore, and a movable core adapted to slide elastically and in fluid-tight manner in the cylindrical bore between a sealing position (occupied when the two connector elements are not coupled) for which it closes the cylindrical bore in fluid-tight manner and protects the contacts against the liquid medium and a retracted position (occupied when the two connector elements are coupled) for which it is driven into the bore and it disengages the electrical contacts.

From patents FR 2 409 610 and FR 2 529 396, two arrangements of sealed electrical connectors utilizable in a liquid medium, particularly submarine use, are already known, which arrangements both however suffer from the drawback of being complex and hence expensive.

To satisfy the exigencies of practice, it is found therefore to be necessary to provide a new simpler arrangement for such connectors which, however, procure the same safety of operation as the prior connectors, particularly as regards the connection and disconnection within the liquid medium, and which are in addition arranged to procure a prolonged life span of certain component parts particularly sensitive to the agressive nature of the surrounding liquid medium, in particular sea water.

GENERAL DESCRIPTION OF THE INVENTION

With these objects, an electrical connector arranged according to the invention is characterized in that:

(a) the other connector element (or second connector element) comprises:

- a cylindrical body in the form of an axial finger having a diameter corresponding substantially to the diameter of the cylindrical bore of the first connector element,
- electrical contacts distributed circumferentially over the periphery of the cylindrical body,
- a jacket in the form of a bush surrounding at a radial distance said cylindrical body and arranged to co-operate with the jacket of the first connector element, and
- a removable cap to close said jacket when the second connector element is not coupled to the first connector element, and the respective arrangements for the first and second connector elements being such that the cylindrical body is movable in fluid-tight manner like a piston in said bore of the first connector element, between a disengaged position (occupied when the two connector elements are not coupled) for which the cylindrical body is not engaged within the bore and a driven-in position (occupied when the two connector elements are coupled) for which the cylindrical body is engaged within the bore with the movable core elastically repelled into its above-mentioned retracted position, the length of penetration of the cylindrical body in the bore being such that the contacts of the first and second connector elements co-operate respectively in pairs;

(b) the respective contacts of the two connector elements are supported in insulating bodies provided respectively on the periphery of the cylindrical bore of the first connector element and on the periphery of the cylindrical body of the second connector element;

(c) the one or more insulating bodies borne by the cylindrical body of the second connector element are constituted of polytetrafluoroethylene (such as Teflon) and their external surface is flush with the external surface of the cylindrical body, the electrical contacts being buried in the insulating mass with their contact surface flush with the external surface of this insulating mass;

(d) the one or more insulating bodies situated in the cylindrical bore of the first connector element are constituted of an elastically deformable elastomer, particularly a radially deformable elastomer, this one or more insulating bodies projecting, in their undeformed state, on the surface of the cylindrical bore;

(e) the or each insulating body situated in the cylindrical bore of the first connector element comprises two radial housings open towards the inside of the bore and distributed circumferentially to shield the respective contacts, each contact being mounted in its housing with the possibility of elastic radial movement, the surface of each contact being substantially flush with the surface of the body in its undeformed state.

Thus the constitution of the second connector element is found to be simplified with respect to what it was in the prior connectors of the same type and tests have shown that it was possible to design this second element with a protective cap held in place until the moment of connection with the first protective element: the placing in contact of the contact parts of the second element with the liquid medium (for example sea water) had no unfavorable consequences on the life span of the components, and particularly of the constituent insulating material of the insulating crown supporting the contacts, provided that a material (such as polytetrafluoroethylene) is chosen inert with respect to the liquid medium and had no consequence either on the reliability of the electrical connections, in providing a connector arrangement resulting in removal of the liquid in the course of the connection process. To this end, there can be provided, on the front annular edge of the first connector element, an annular seal with lips forming a scraper and co-operating closely, in fluid-tight manner, with the surface of the cylindrical body of the second connector element to prevent any passage of liquid in the course of coupling.

Thus, the annular insulating crown supporting the contact of the first connector element, which is constituted of elastomer having a relative sensitivity to agressive liquids such as sea water, is found to be effectively protected and its life span is thus increased. The mounting of each contact in the elastomer with the possibility of radial movement ensures, throughout the life span of the connector, satisfactory support of the contact on its homolog in connection position and procures a take-up of play compensating for the relative loss of elasticity of the elastomer over time.

In a particularly simple arrangement, the insulating bodies shielding the contacts are arranged in the form of two annular crowns respectively in the first and second connector elements.

In a preferred embodiment, there is provided in each contact housing of the first connector element, a rigid cup, particularly of metal, forming a cylinder in which the piston-forming electrical contact can slide radially, elastic return means into resting position of the contact being inserted between the cup and the contact. Advantageously, the elastic return means comprise at least one spring inserted between the contact and the bottom of the cup; if necessary, the contact is constituted in the form of a solid metal stud pierced by an axial bore extending radially into the connector element open towards the bottom of the cup and shielding in part the return spring.

To ensure the integrity of the assembly, it is desirable for retaining means to be inserted between the cup and the contact to make them fast mechanically with one another with the possibility of sliding of the contact with respect to the cup and to limit the amplitude of the sliding; advantageously, these retaining means comprise at least one lateral projection fast to the contact and at least one groove directed axially in the lateral wall of the cup to receive this projection; for example, the projection of the contact is an annular ring engirdling the contact and the groove of the wall of the cup is annular.

BRIEF DESCRIPTION OF THE DRAWINGS

The invention will be better understood on reading the detailed description which follows of a preferred embodiment given purely by way of illustrative example; in this description, reference is made to the accompanying drawings in which.

DESCRIPTION OF A PARTICULAR EMBODIMENT

Figure 1:
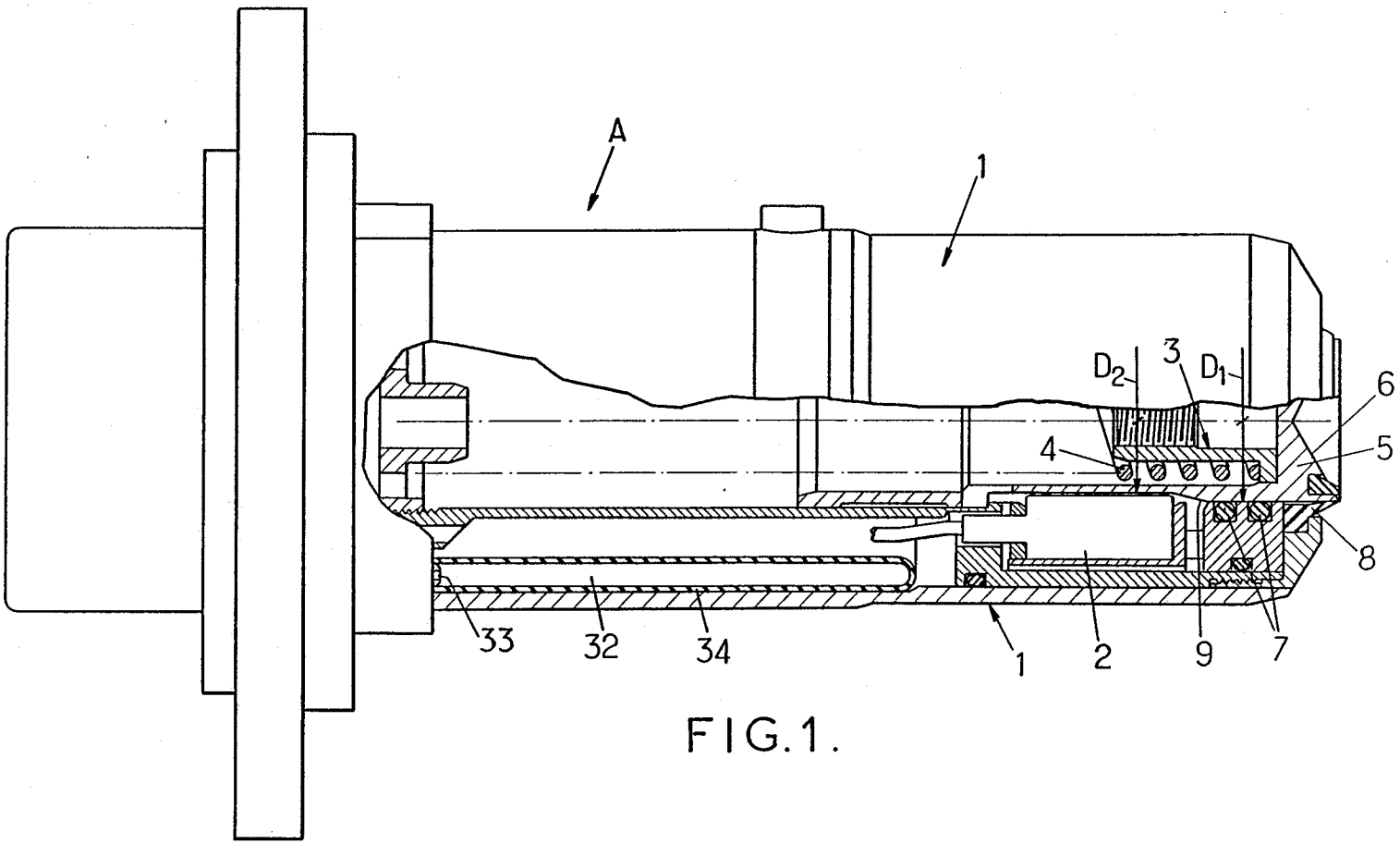
FIG. 1 is a side view with part torn away showing certain components in diametric section, of a first connector element or socket, arranged according to the invention.

FIG. 1 shows a first connector element, denoted as a whole by the reference A, which is arranged, by way of example, in the form of a connector socket, that is to say that this connector element is mounted permanently on an organ or support device through suitable fastening means. Through this fact, this socket A remains permanently immersed in the liquid medium (for example sea water) into which the organ or support device is plunged and it is arranged, as described below, so as to prevent the penetration of the liquid into its midst, both when it is in disconnected position (as shown in FIG. 1) and in the course of connection and in connected position with the second connector element shown in FIG. 2.

The socket A comprises essentially an outer jacket 1 shielding, particularly, an annular contact holder body constituted in the form of an annular crown 2 of elastomer shielding contacts, as will be described in more detail below with reference to FIGS. 3 to 6.

In the central cylindrical portion of the socket A is positioned a movable core 3 adapted to slide axially and to be pushed forwards (to the right in FIG. 1) under the action of a return spring 4. The end zone 5 of the core 3 is axially hollowed by a conical positioning cavity 6 whose role will be described later. In addition, this same end zone 5 of the core 3 possesses an external diameter $D_1$ substantially greater than the diameter $D_2$ of its portion situated behind the end zone and this end zone 5 co-operating, in the unconnected position shown in FIG. 1, with sealing members (for example toric seals 7) borne by the opening of the jacket 1; in addition this same opening is equipped with an annular sealing seal 8 with lips supported against the end zone 5 of the movable core 3 and constituting a scraper component adapted to prevent the penetration of liquid in the course of coupling as will be explained below.

The annular crown 2 of elastomer possesses an internal diameter about the same as nominal diameter $D_2$ and co-operates, in the unconnected position shown in FIG. 1, with the portion of diameter $D_2$ of the movable core 3.

On the core, the areas of diameter $D_1$ and $D_2$ are joined by a frustoconic surface 9 forming an annular ramp.

For the rest, the socket A comprises all the arrangements known to the technician skilled in the art for this type of component and which, not being directly involved by the invention, are not described here.

Figure 3:
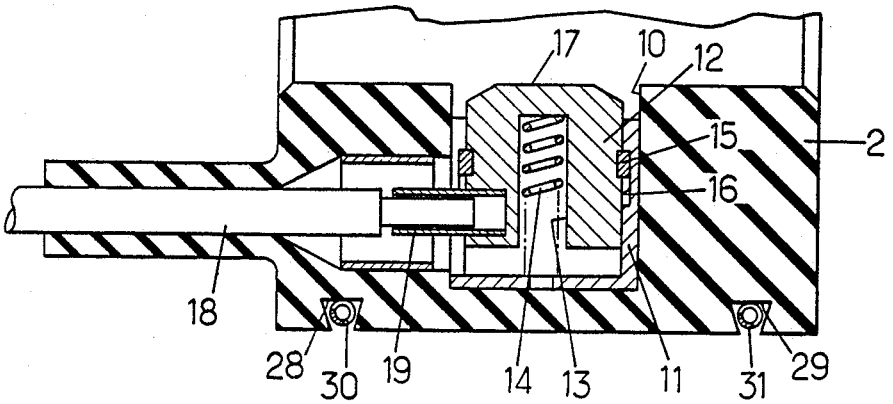
FIG. 3 is a sectional view on an enlarged scale, of a portion of the first connector element of FIG. 1.
Figure 4:
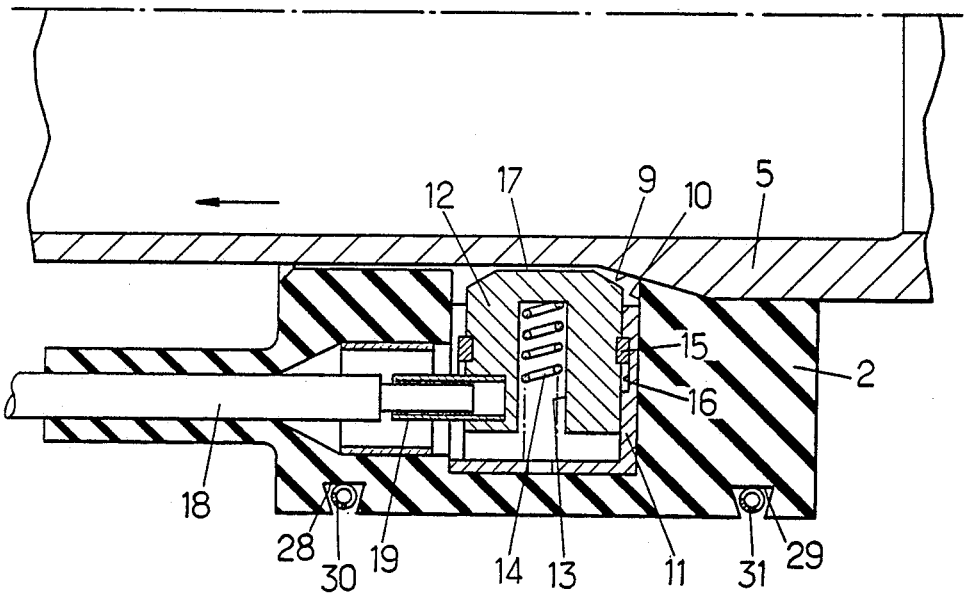
FIGS. 4 to 6 are views of the portion shown in FIG. 3 illustrated in several functional positions.

FIG. 3 shows in detail the constitution of the electrical contacts with which the socket A is equipped. The insulating crown of elastomer 2 is provided with housings 10 distributed circumferentially and extending radially with their opening turned towards the inside of the crown 2. Each housing 10 shields a metal cup 11 in which is placed slidingly an electrical contact-forming metal block 12. Each contact 12 is pierced by a bore 13 open to its rear surface (turned towards the bottom of the cup 11) and in which is placed a helical spring 14 supported on the bottom of the cup 11 to push back the contact 12 radially towards the inside of the socket A. The amplitude of the sliding of the contact 12 is limited by suitable retaining means, for example by a projecting annular ring 15 engirdling the contact 12 and fast to the latter and engaged in an annular groove 16, hollowed in the inner lateral wall of the cup 11 and having a suitable width corresponding to the authorized travel.

In the resting or unconnected position of the socket A shown in FIGS. 1 and 3, the front surface or active surface 17 of the contacts 12 is situated substantially flush with the surface of the elastomeric crown 2.

In addition, for each electrical contact 12, the corresponding electrical conductor 18 has its bare end made fast (by crimping and/or welding) with a connecting sleeve 19 itself made fast (by force-fitting or screwing) in the lateral wall of the contact 12, the cup 11 having a suitable cut-out for the passage of the conductor.

Figure 2:
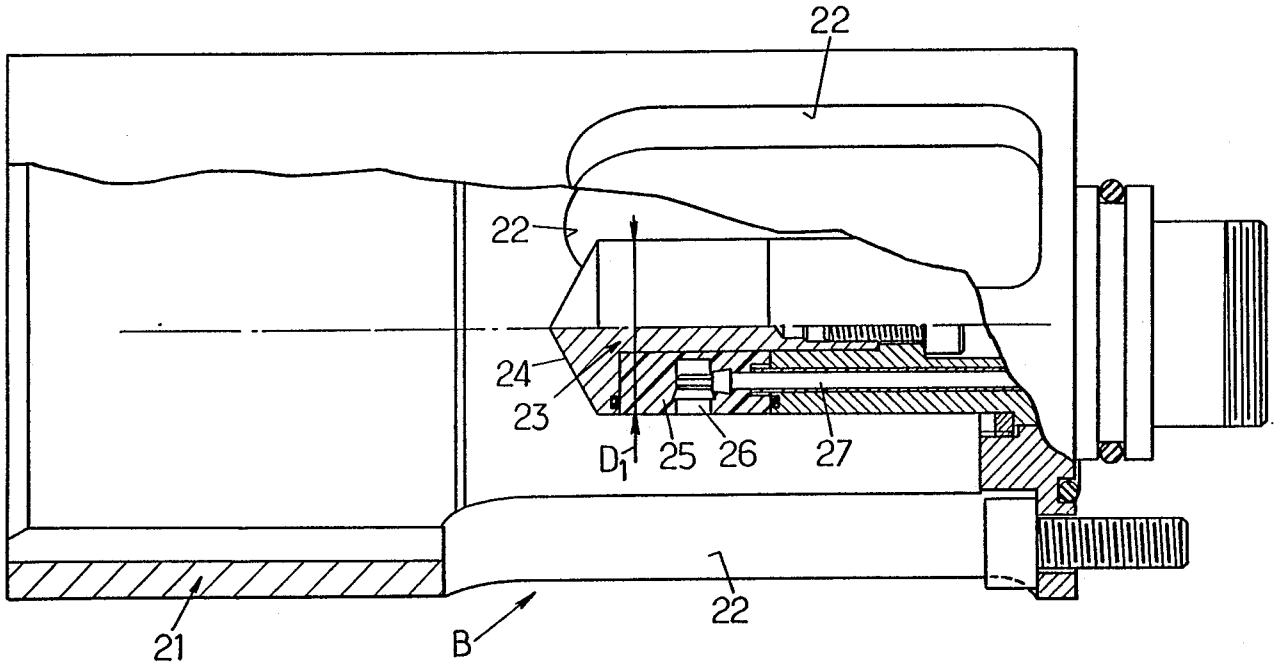
FIG. 2 is a side view, with part torn away showing certain components in diametric section, of a second connector element or plug, arranged according to the invention.

FIG. 2 shows a second connector element, denoted as a whole by the reference B, which is arranged, in the example concerned, in the form of a connector plug, that is to say a movable connection element mounted at the end of an electric cable (not shown) which is designed to be mechanically coupled with the socket A to ensure then the continuity of electrical circuits through respective electrical contacts of the socket A and of the plug B.

The plug B comprises essentially an outer jacket 21 of cylindrical form shaped and dimensioned so that, in the connected position of the plug B with the socket A, it caps the jacket 1 of the socket A tightly. The jacket 21 is provided with one or several lateral openings 22 permitting the removal of the liquid driven back in the course of the coupling process.

Within the jacket 21 and at a radial distance from the latter extends a cylindrical body 23 in the form of an axial finger. The front end 24 of the cylindrical body 23 is of conical shape to co-operate with the conical axial cavity 6 of the movable core 3 of the socket A.

The outer diameter of the cylindrical body 23 is substantially the diameter $D_1$ of the front zone 5 of the movable core 3 of the socket A.

In the cylindrical body 23 is embedded an insulating annular crown 25, constituted of a relatively hard insulating material such as polytetrafluoroethylene (for example Teflon), in which are buried metal studs constituting electrical contacts 26, themselves being connected electrically (for example by metal rods 27 force-fitted into contacts 26) with electrical conductors (not shown) of the electric cable (not shown) to which the plug B is made fast.

It will be noted that the free surface of the contacts 26 is substantially flush with the free surface of the insulating crown 25, which is flush with the surface of the cylindrical body 23.

Finally, a removable cap closes the openings of the jacket 21 of the plug B to insulate the internal components (and particularly the contacts 26) from the surrounding liquid up to the moment of connection of the plug B with the socket A. In FIG. 2, the cap is not shown, the plug B being assumed to be positioned facing the socket A, for coupling with the latter.

The operation of the connector is effected in the following manner, the plug B being assumed to be the removable element that it is desired to couple with the socket A, assumed fixed.

In unconnected position, the socket A and the plug B are in their respective conditions shown in FIGS. 1 and 2.

Figure 5:
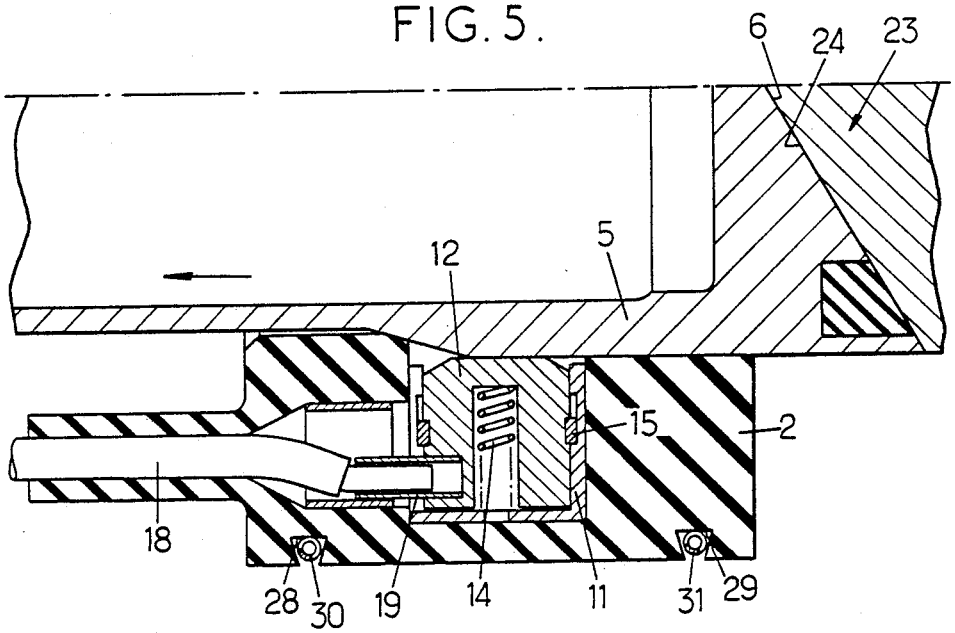
Figure 6:
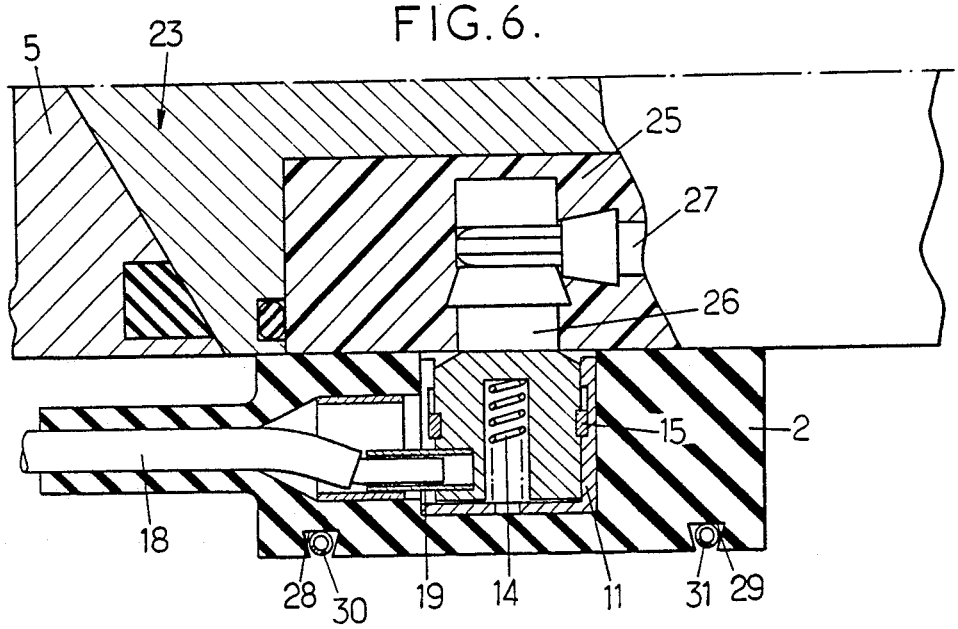

In the course of the connecting process, the jacket 21 of the plug B caps the jacket 1 of the socket A. Then the cylindrical body 23 of the plug B comes into abutment against the movable core 3 of the socket A, the relative axial alignment of the cylindrical body 23 and of the core 3 being facilitated by the co-operation of the conical end 24 of the first with the conical cavity 6 of the second. The movable core 3, pushed back by the cylindrical body 23, then withdraws into the socket A compressing the return spring 4. In the course of this movement, and due to the fact of the presence of the annular ramp 9, the end zone 5 of the movable core, which possesses an increased diameter $D_1$, dilates the annular crown 2 of elastomer (FIG. 4) then pushes back the electrical contacts 12 radially against the return action of their respective springs 14 (FIG. 5).

Due to the fact that the cylindrical body 23 possesses the same diameter $D_1$ as the end zone 5 of the core 3 of the socket A, the movement continues until complete coupling of the plug B with the socket A. In this position (FIG. 6), the electrical contacts 26 of the plug B and 12 of the socket A are mutually opposite and are supported respectively against one another under the effect of the springs 14.

Due to the arrangement according to the invention, the structure of the connector is distinctly simplified with respect to that of connectors of the same type of the prior art, in particular as regards the plug B, which simplification results from the observation that the components of the plug could undergo a short contact with the surrounding liquid without substantial damage resulting therefrom nor notable reduction of the life span. However, these results have been obtainable due to a simple but effective arrangement seeking to eliminate automatically any trace of liquid (which is electrically conducting when it is sea water) in the area of the electrical contacts.

First of all, the lip seal 8 of the socket A co-operates with the outer surface of the movable core 3 of the socket A, then with the cylindrical body 23 of the plug B, on the one hand by contributing to the fluid-tightness in combination with the toric seals 7 and preventing penetration of the liquid into the socket and, on the other hand, by procuring a scraping effect eliminating any trace of liquid on the surface of the cylindrical body 23 during the penetration of the latter into the socket A, and in particular on the free surface of the electrical contacts 26.

This removal of the liquid is particularly important also as regards the insulating crown 2 of elastomer, thus avoiding placing the latter in contact with the liquid when the elastomer is made fragile and deteriorates (with concomitant reduction in its dielectric properties) on prolonged contact of certain liquids such as sea water.

In addition, the action of removing traces of liquid at the level of the contacts is reinforced by the fluid-tight grip of the cylindrical body 23 by the insulating crown 2 of elastomer which is dilated.

In addition, should there remain liquid in the connector at the end of the coupling of the elements A and B, the elastic support of the insulating crown 2 of elastomer on the insulating crown 25 of PTFE ensures good fluid-tight insulation of the electrical contacts 12, 26 with respect to the remainder of the connector and no electrical leakage from this point of view is to be feared.

Finally, the elastic mounting of the electrical contacts 12 in the insulating crown 2 enables an automatic and permanent taking-up of play to be ensured, and hence there is ensured permanently and throughout the life span of the connector a suitable elastic support of the contacts 12 against the contacts 26, in spite of the progressive and inevitable loss of elasticity of the elastomer due to ageing of the latter.

In addition, precisely to attempt to overcome drawbacks due to a relaxation of the radial clamping force exerted by the insulating crown 2 in consequence of the aforesaid loss of elasticity of the elastomer due to the ageing of the latter, there are provided additional means elastically deformable radially which act in the same manner as the mass of elastomer and reinforce the effect of the latter. To this end, as shown more particularly in FIGS. 3 to 6, the outer surface of the insulating crown 2 is hollowed by two grooves 28 and 29, separated from one another so that they are situated approximately on each side of the housings 10 shielding the contacts 12. These grooves have a transverse profile which is substantially trapezoidal or dove-tailed and shields two elastic clamping rings, respectively 30 and 31, which can advantageously be constituted each by a spiral spring wound into a ring.

Thereby generally results a notable increase in the life span of the connector, in spite of the simplification contributed to the structure particularly of the plug B.

In addition, it will be noted that, in a manner for the rest known in itself, the connector element A described above is arranged so that the space inside its jacket 1 is kept permanently under a pressure equal to that outside, and this in order to permit without difficulty the connection and disconnection of the elements A and B even when these operations are carried out within a liquid medium under high pressure, for example in a submarine environment at great depth. To this end, there is provided, within the jacket 1 of the element A, a chamber 32 communicating with the outside medium through an orifice 33 and hence filled with the external fluid under pressure. This chamber is isolated from the rest of the inner space of the jacket 1—which is filled with electrically insulating oil—by a membrane 34 elastically deformable which hence transmits to the oil the external pressure. Due to this arrangement, the movable core 3 can be moved freely under the previously explained conditions.

As is self-evident and as results besides already from the foregoing, the invention is in no way limited to those of its types of application and embodiments which have been more especially envisaged; it encompasses on the contrary all modifications thereof.

We claim:

1. Electrical connector which has to operate in fluid-tight manner in a liquid medium under high pressures, comprising two connector elements (A,B) couplable removably to one another within the liquid medium and bearing respective contacts designed to co-operate in pairs, in which:

one (A) of the connector elements (or first connector element) comprises:

a jacket having a cylindrical bore, electrical contacts distributed circumferentially at the surface of the cylindrical bore, and a movable core adapted to slide elastically and in fluid-tight manner in the cylindrical bore between a closed position (occupied when the two connector elements are not coupled) for which it closes in fluid-tight manner the cylindrical bore and protects the contacts against the liquid medium and a retracted position (occupied when the the two connector elements are coupled) for which it is driven into the bore and it disengages the electrical contacts; and the other (B) of the connector elements (or second connector element) comprises:

a cylindrical body in the form of an axial finger having a diameter corresponding substantially to the diameter of the cylindrical bore of the first connector element, electrical contacts distributed circumferentially over the periphery of the cylindrical body, and a jacket in the form of a bush surrounding at a radial distance said cylindrical body and arranged to co-operate with the jacket of the first connector element, said cylindrical body being fast to this jacket and being supported in fixed manner with respect to the latter;

and wherein:

(a) the respective arrangements of the first and second connector elements being such that the cylindrical body is movable in fluid-tight manner like a piston in said bore of the first connector element, between a disengaged position (occupied when the two connector elements are not coupled) for which the cylindrical body is not engaged inside the bore and a driven-in position (occupied when the two connector elements are coupled) for which the cylindrical body is engaged inside the bore with the movable core pushed back elastically into its above-mentioned retracted position, the length of penetration of the cylindrical body into the bore being such that the contacts of the first and second connector elements co-operate in pairs respectively;

(b) the respective contacts of the two connector elements are supported in one or more insulating bodies provided respectively on the periphery of the cylindrical bore of the first connector element and on the periphery of the cylindrical body of the second connector element;

(c) the one or more insulating bodies borne by the cylindrical body of the second connector element are constituted of polytetrafluoroethylene and their outer surface is flush with the outer surface of the cylindrical body, the electrical contacts being buried in one of the insulating bodies with their contact surface flush with the outer surface of one of the insulating bodies;

(d) the one or more insulating bodies situated in the cylindrical bore of the first connector element are constituted of an elastomer elastically deformable, particularly radially, the one or more insulating bodies projecting, in their undeformed state, beyond the surface of the cylindrical bore; and (e) each of the one or more insulating bodies situated in the cylindrical bore of the first connector element comprises radial housings open towards the inside of the bore and distributed circumferentially to shield the respective contacts, each contact being mounted in its housing with the possibility of elastic radial movement, the surface of each contact being substantially flush with the surface of each respective insulating body in its undeformed state.

2. Connector according to claim 1, wherein the front annular edge of the first connector element is provided with a lip seal forming a scraper designed to co-operate in fluid-tight manner with the outer surface of the cylindrical body of the second connector element.

3. Connector according to claim 1, wherein the insulating bodies shielding the contacts are arranged in the form of two annular crowns respectively in the first and second connector elements.

4. Connector according to claim 3, wherein the annular crown forming the insulating body of the first connector element is surrounded by at least one ring elastically deformable radially and adapted to reinforce the natural elasticity of the constituent material of this annular insulating crown.

5. Connector according to claim 1, wherein in each housing of the contacts of the first connector element is provided a cup of a rigid material, particularly of metal, forming a cylinder in which the electrical contact can slide forming a piston, elastic return means in the resting position of the contact being inserted between the cup and the contact.

6. Connector according to claim 5, wherein the elastic return means comprise at least one spring inserted between the contact and the bottom of the cup.

7. Connector according to claim 6, wherein the contact is constituted in the form of a solid metal stud pierced by an axial bore extending radially in the connector element open towards the bottom of the cup and shielding in part the return spring.

8. Connector according to claim 5, wherein retaining means are interposed between the cup and the contact to make them mechanically fast to one another with the possibility of sliding of the contact with respect to the cup and to limit the amplitude of this sliding.

9. Connector according to claim 8, wherein the retaining means comprise at least one lateral projection fast to the contact and at least one groove directed axially in the lateral wall of the cup to receive this projection.

10. Connector according to claim 9, wherein the projection of the contact is an annular ring gripping the contact and wherein the groove of the wall of the cup is annular.

* * * * *